United States Patent [19]

Gotoh

[11] 4,183,381

[45] Jan. 15, 1980

[54] METHOD OF AND DEVICE FOR DETECTING AN IMPROPER PICK OF WEFT YARN IN A WEAVING LOOM

[75] Inventor: Miyuki Gotoh, Tokorozawa, Japan

[73] Assignee: Nissan Motor Company, Limited, Japan

[21] Appl. No.: 919,614

[22] Filed: Jun. 27, 1978

[30] Foreign Application Priority Data

Jun. 29, 1977 [JP] Japan ..... 52-76628

[51] Int. Cl.[2] ..... D03D 51/18

[52] U.S. Cl. ..... 139/370.1; 340/677

[58] Field of Search ..... 139/336, 348, 349, 370.1, 139/370.2; 66/161, 162, 166; 340/675, 677

[56] References Cited

U.S. PATENT DOCUMENTS

| | | | |
|---|---|---|---|
| 3,613,743 | 10/1971 | Sakamoto | 139/336 |
| 3,678,969 | 7/1972 | Gotoh | 139/370.1 |
| 3,731,069 | 5/1973 | Goto | 340/677 |
| 3,967,656 | 7/1976 | Gotoh | 139/370.2 |
| 4,067,365 | 1/1978 | Gotoh | 139/370.1 |
| 4,082,119 | 4/1978 | Washino | 139/370.2 |

*Primary Examiner*—Henry Jaudon

*Attorney, Agent, or Firm*—Robert E. Burns; Emmanuel J. Lobato; Bruce L. Adams

[57] ABSTRACT

For detecting an improperly inserted pick of weft yarn in a weaving loom, a tension signal representative of a total of tensions detected of a predetermined number of warp yarns forming an end portion of the weaving shed during beating of the weft yarn in each cycle of operation of the loom is compared with a variable reference signal which is representative of, for example, a predetermined fraction of the arithmetic means of the sums of the warp yarn tensions detected during the cycles of operation prior to the cycle in which the tension signal is produced and compared with the reference signal.

18 Claims, 3 Drawing Figures

METHOD OF AND DEVICE FOR DETECTING AN IMPROPER PICK OF WEFT YARN IN A WEAVING LOOM

FIELD OF THE INVENTION

The present invention relates to a method of and a device for detecting an improper pick of weft yarn in a weaving loom having a weft-filling stage in which a pick of weft yarn is inserted into the weaving shed of warp yarns during each of the weaving cycles of the loom and beaten up onto the fell of the woven cloth toward the end of each cycle of operation of the loom.

GENERAL BACKGROUND OF THE INVENTION

As well known in the art, the tensions in the warp yarns forming a shed in a weaving loom increase temporarily during beating operation in which the pick of weft yarn which has been inserted into the shed during each cycle of operation of the loom is beaten up onto the edge or "fell" of the woven fabric at the trailing end of the fabric which is being produced. It is further known that the degrees of variation in the tensions produced in the warp yarns during beating operation are greater in those warp yarns which are engaged by the weft yarn being beaten up than those warp yarns, if any, with which the weft yarn being beaten up has failed to engage. An improper pick detecting device has therefore been proposed and put into use for detecting a pick of weft yarn which has failed to be inserted throughout the width of the weaving shed is detected by monitoring the tensions in several to tens of warp yarns forming part of the shed. The tensions in these warp yarns are detected by means of a tension sensing unit which is arranged to be constantly in contact with the particular warp yarns for producing an analog electric signal continuously variable with the total of detected warp yarn tensions during weft beating operation in each cycle of operation of the loom. The analog signal thus produced by the individual tension sensing unit is compared with a reference signal which is representative of the sum of warp yarn tensions to be produced when the warp yarns are engaged during beating operation by a pick of weft yarn which has failed to reach the farthest end of the weaving shed but which has been inserted into the shed to a length covering most of the warp yarns or, more exactly, a practically allowable minimum proportion of the total width of the shed. If the signal representative of the warp yarn tensions detected during beating operation in a certain weaving cycle of the loom is proved to be lower in magnitude than such a reference signal, the improper pick detecting device delivers an output signal indicating that the pick of the weft yarn which has been inserted into the shed during the particular weaving shed is improper, or has failed to cover the allowable minimum proportion of the total width of the shed. The output signal of the improper pick detecting device is used typically for causing the loom to a stop or producing a warning signal so as to enable the operator of the loom to service or troubleshoot the loom as the weft-filling stage of the loom.

When the weaving operation is interrupted in the process of producing a woven fabric, a "stop mark" tends to be formed in the barbic and impairs the commercial value of the fabric completed. In order to minimize the number of the stop marks to be produced in a woven fabric to be manufactured by a loom equipped with an improper pick detecting device of the above described nature, it is desirable that the value represented by the reference signal to be produced in the device be set to be as small as possible. If the reference signal is reduced in magnitude to achieve such a purpose, then the improper pick detecting device would objectionably respond to the variation in the warp yarn tensions which increase as the diameters of the rolls of the warp yarns on a warp beam of the loom vary as well known in the art.

In another type of prior-art improper pick detecting device used in a weaving loom, a signal representative of the warp yarn tensions detected during beating operation in each cycle of operation of the loom is memorized and utilized for producing a reference signal to be used in the immediately subsequent cycle of operation. The reference signals thus produced are practically free from the effects of the above mentioned cyclic variation in the warp yarn tensions but are, instead thereof, affected by the constructive interference between the waves of vibration of the detecting device and the support for the detecting device as will be explained in greater details.

In a dobby loom in which the weaving shed is formed by three or more sets of warp yarns in each cycle of operation of the loom, the tensions in the warp yarns not only increase as above described but vary from one cycle of operation to another of the loom because each of the weft yarns to form each of the complete weaves (to be defined later) of the fabric to be woven is contacted by the warp yarns which are arranged differently from the warp yarns to be contacted by the other weft yarns in each complete weave.

All these problems encountered in prior-art improper pick detecting devices of the described types are ascribed to the lack of reliability of the reference signals used in such devices.

An important object of the present invention is, therefore, to provide a method of and a device for detecting an improper pick of weft yarn in a weaving loom by producing a reference signal which is not susceptible to the effects of extraneous factors which are inherent in the loom.

It is another important object of the present invention to provide a method of and a device for detecting the occurrences of improper picks of weft yarn in a weaving loom without the risk of causing frequent and/or objectionalbe interruptions of the weavinf operation in the process of manufacturing a woven fabric in the loom.

Yet, it is another important object of the present invention to provide a method of and a device for detecting an improper pick of weft yarn in a weaving loom accurately and reliably regardless of the periodic variation in the tensions in the warp yarns forming a shed in the loom.

It is still another important object of the present invention to provide a method of and a device for detecting an improper pick of weft yarn in a weaving loom without being affected by the mechanical vibrations to be produced in the loom during operation.

SUMMARY OF THE INVENTION

In accordance with one outstanding aspect of the present invention, there is provided a method of detecting an improper pick of weft yarn in a weaving loom having a weft filling stage in which a pick of weft yarn is to be inserted across a weaving shed having a weft inserting end and beaten up onto the fell of a woven cloth during each cycle of operation of the loom, comprising detecting a total of tensions in a predetermined number of warp yarns, producing an electric tension signal representative of the warp yarn tensions detected during beating of the weft yarn in each cycle of operation of the loom, storing each of the tension signals for a predetermined number of consecutive cycles of operation subsequent to each of the cycles in which the tension signals are produced, producing a variable reference signal representative of the values respectively represented by a predetermined number of stored tension signals, comparing each of the tension signals with the reference signal which is produced during the cycle of operation prior to the cycle in which the tension signal to be compared with the reference signal is produced, and producing an output signal if and when the value represented by the tension signal compared with the reference signal is in a predetermined relationship to the value represented by the latter.

In accordance with another outstanding aspect of the present invention, there is provided an improper pick detecting device for use in a weaving loom having a weft filling stage in which a pick of weft yarn is to be inserted across a weaving shed having a weft inserting end and beaten up onto the fell of a woven cloth during each cycle of operation of the loom, comprising tension signal generating means for detecting a total of tensions in a predetermined number of warp yarns and producing an electric tension signal representative of the warp yarn tensions detected during beating of the weft yarn in each cycle of operation of the loom, reference signal generating means for storing each of the tension signals for a predetermined number of consecutive cycles of operation subsequent to each of the cycles in which the tension signals are produced and producing a variable reference signal representative of the values respectively represented by a predetermined number of stored tension signals, and comparing means for comparing each of the tension signals with the reference signal which is produced during the cycle of operation prior to the cycle in which the tension signal to be compared with the reference signal is produced and producing an output signal if and when the value represented by the tension signal compared with the reference signal is in a predetermined relationship to the value represented by the latter.

The predetermined number of the tension signals on the basis of which each of the reference signals is to be produced during each cycle of operation of the loom may coincide with the predetermined number of the above mentioned consecutive cycles of operation of the loom. When the present invention is to be applied to dobby weaving for producing a woven cloth having a succession of complete weaves each containing a predetermined number of weft yarns, the predetermined number of the above mentioned consecutive cycles of operation of the loom is the product of the number of the weft yarns to form each of the complete weaves and the predetermined number of the tension signals on the basis of which each of the reference signals is to be produced.

BRIEF DESCRIPTION OF THE DRAWINGS

The features and advantages of a method and a device provided by the present invention will be more clearly understood from the following description taken in conjunction with the accompanying drawings in which.

DETAILED DESCRIPTION OF THE INVENTION

Figure 1:
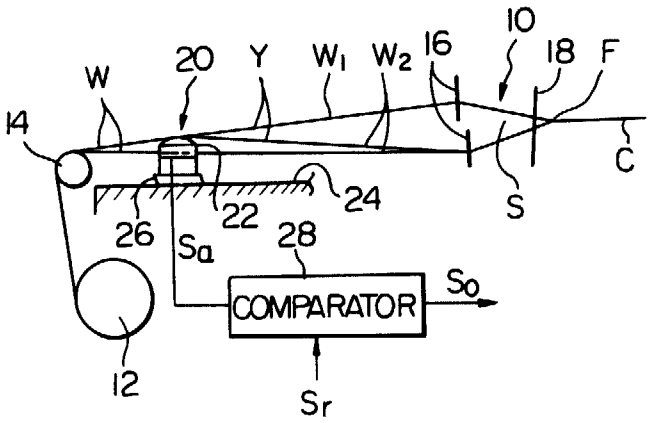
FIG. 1 is a schematic side elevation view showing a general arrangement of a weaving loom having a prior-art improper pick detecting device of the type to which the present invention relates.

Referring to FIG. 1 of the drawings, an automatic weaving loom to which the present invention appertains has a weft-filling stage 10 at which continuous warp yarns W rearwardly conveyed from a supply cylinder or warp beam 12 by way of a guide or back rest roller 14 are grouped into two webs $W_1$ and $W_2$ which are angularly spaced apart from each other in a vertical direction so as to form therebetween a generally horizontally extending weaving shed S at the rear of the fell F of a woven cloth C extending forwardly from the weft-filling stage 10. In the vicinity of one lateral end of the weaving shed S thus formed by the warp yarns W at the weft-filling stage 10 of the loom is positioned a weft-inserting motion (not shown) for shooting or carrying a pick of weft yarn across the weaving shed S during each cycle of operation of the loom, as well known in the art. The weft-inserting motion provided in the automatic weaving loom being herein described is assumed, by way of example, to be of the shuttleless type which is adapted to shoot a pick of weft yarn by means of a jet stream of fluid under pressure such as compressed air ejected into the weaving shed S with the pick of the weft yarn entrained thereon. The shuttleless weft-inserting motion thus comprises a fluid discharge nozzle located in proximity to one lateral end of the weaving shed S and communicable with a source of the fluid under pressure through a valved passageway which is opened up during each cycle of operation of the loom. The weft yarn to be shot from the nozzle is cyclically supplied from a suitable yarn supply package through yarn-drawing, length-measuring and weft-detaining means intervening between the nozzle and the yarn supply package so that a predetermined length of weft yarn is fed to the fluid discharge nozzle each time the nozzle is actuated to discharge fluid therefrom. The weft-inserting motion of the above described nature and the yarn-drawing, length-measuring and weft-detaining means associated with such a motion being well known in the art and being rather immaterial to the understanding of the important features of the present invention, the constructions and arrangements thereof are not herein shown and described in detail.

The weaving shed S formed by the warp yarns W is changed in each of the weaving, viz., weft filling cycles of the loom by means of a shedding mechanism which comprises a number of healds 16 provided rearwardly of the shed S, as schematically illustrated in FIG. 1. Each of the healds 16 has a healed eye (not shown) through which each of the warp yarns W forming the weaving shed S is loosely passed toward the fell F of the woven cloth C. The healds 16 are arranged in two or more groups each consisting of a plurality of healds which are jointly attached to a common heald frame (not shown) which is vertically movable in the rear of the weaving shed S. In an ordinary loom employed for plain-tappet weaving, for example, there are provided to heald frames one of which holds the healds for the warp yarns forming one of the webs $W_1$ and $W_2$ and the other of which holds the healds for the warp yarns forming the other of the webs $W_1$ and $W_2$. The two heald frames are alternately raised and lowered under the control of a tappet cam mechanism so that the two webs $W_1$ and $W_2$ are alternately raised and lowered to form the weaving shed S therebetween. In another type of loom such as a dobby loom, for example, the shedding mechanism comprises three or more heald frames which are selectively raised and lowered under the control of a pattern-card arrangement so that, in each of the weaving cycles of the loom, one of the two webs $W_1$ and $W_2$ is formed by the warp yarns passed through the healds supported by one or more of the heald frames and the other of the webs $W_1$ and $W_2$ is formed by the warp yarns passed through the healds supported by the remaining heald frame or frames, as is well known in the art. Each time the weaving shed S is thus formed at the weft-filling stage 10 of the loom in operation, the weft-inserting motion of the loom is actuated to shoot or otherwise carry a pick or measured length of weft yarn (not shown) across the shed S through one lateral end of the shed, as previously discussed. The lateral end of the weaving shed S through which a pick of weft yarn is to be inserted into the shed is herein referred to as weft inserting end of the shed.

The pick of the weft yarn thus inserted across the weaving shed S during each cycle of operation of the loom is beaten up onto the fell F of the woven cloth C toward the end of the cycle by means of a weft beat-up mechanism which comprises a reed 18 constituted by a comb-like arrangement of a number of flattened steel wires or dents secured to a single frame structure. The reed 18 is positioned between the fell F of the woven cloth C and the above described shedding mechanism and is movable toward and away from the cloth fell. During weft inserting operation, the reed 18 is held in a rest position rearwardly spaced apart from the fell F of the woven cloth C so that the weaving shed S having its front end at the cloth fell has a rear end defined by reed 18. Upon completion of the weft inserting operation in each weaving cycle of the loom, the reed 18 is driven to move forwardly from the rest position and thus pushes the pick of the weft yarn against the edge of the woven cloth at the trailing end or fell F of the cloth. Each cycle of operation of the loom is completed when the reed 18 is moved back to the initial rest position thereof.

During beating up of the weft yarn against the fell F of the woven cloth C, there is caused a temporary increase in the tension in each of the warp yarns leading to the cloth fell. If, in this instance, there is any warp yarn which is not engaged by the weft yarn being pressed against the edge of the woven cloth C by the reed 18 which has been moved to the fell F of the cloth C, the increment in the tension in the particular warp yarn is smaller than the increment in the tension in each of the warp yarns engaged by the weft yarn at the cloth fell. The presence of a warp yarn not engaged by the weft yarn beaten up onto the fell F of the woven cloth C can therefore be detected upon comparison of the degree of variation in the tension in such a warp yarn with the degree of variation in the tension in a warp yarn which has been engaged by the particular weft yarn or with any value representative of an increment in the tension in a warp yarn properly engaged by a weft yarn beaten up onto the fell F of the woven cloth C. An improper pick detecting device has been proposed to put such a principle into practice for detecting a pick of weft yarn which has failed to be properly shot across the weaving shed of warp yarns in an automatic weaving loom.

The improper pick detecting device comprises a tension detector 20 positioned rearwardly of the weft-filling stage 10 preferably between the shedding mechanism and the previously mentioned guide or back rest roller 14 as shown in FIG. 1 and having a tension sensing unit 22 which is located to be engageable with a predetermined number of warp yarns forming a lateral end portion of the weaving shed S opposite to the weft inserting end of the shed, the particular warp yarns being indicated by Y in FIG. 1. The tension sensing unit 22 is arranged in such a manner as to be pressed upon by these warp yarns Y and is operative to produce an analog electric signal Sa which is continuously variable in magnitude with a total of tensions in the warp yarns Y contacted by the sensing unit. The sensing unit 22 is ordinarily of the type which comprises a piezoelectric transducer element which is adapted to produce the above mentioned analog electric signal Sa in the form of a voltage continuously variable with a mechanical pressure exerted on the element. The tension detector 20 as a whole is fixedly mounted on the base or frame structure 24 of the loom by means of a suitable shock absorbing material 26 so that the tension sensing unit 22 is free from external disturbances resulting from the mechanical shocks and vibrations created in or transferred to the base or frame structure 24 during operation of the loom.

In a conventional improper pick detecting device using the tension detector 20, the signal Sa representative of the tensions in the warp yarns Y contacted by the tension sensing unit 22 is fed to a comparator 28 and is compared with a suitable reference signal Sr which is constantly impressed on the comparator 28. When the analog signal Sa fed to the comparator 28 is lower in magnitude than the reference signal Sr, the comparator 28 issues an output signal So as a sign indicating a failure invited in inserting a pick of weft yarn across the weaving shed during the last weft inserting operation. The loom is caused to stop its weaving operation in response to the output signal So thus delivered from the comparator 28. The reference signal Sr impressed on the comparator 28 is representative of a predetermined fraction such as 0.8 for example of the sum of the tensions to be produced in the warp yarns Y when all of the warp yarns are properly engaged during beating by a weft yarn which has been successfully inserted across the weaving shed S. If, therefore, a pick of weft yarn has failed to reach the farthest end of the weaving shed S but has been shot to a length covering the majority of the warp yarns Y, the analog signal Sa supplied to the comparator 28 is higher in magnitude than the reference signal Sr so that the loom is allowed to continue its weaving operation in the absence of an output signal from the comparator 28. In the event, however, a pick of weft yarn has failed to reach the warp yarns Y or has been shot into the weaving shed S to a length short of covering the majority of the warp yarns Y, then the analog signal Sa fed to the comparator 28 becomes lower in magnitude than the reference signal Sr with the result that the comparator 28 delivers the output signal So and brings the loom to a stop or produces a suitable warning signal so as to anable the operator of the loom to manually service or trouble-shoot the loom at the weft-filling stage 10.

When weaving operation is interrupted in the process of producing a woven fabric, there is created a "stop mark" in the fabric being produced. Thus, frequent breaks of weaving operation result in deterioration of the commercial value of the resultant fabric. From this point of view, it is desirable that the fraction used as a coefficient in the above mentioned reference signal Sr be selected at the smallest possible value so that the weaving operation once started is interrupted at the lowest possible frequency.

On the other hand, the tensions in the warp yarns set on a loom not only vary temporarily during beating of a weft yarn but gradually increase as the warp yarns W are fed from the warp beam 12 and the rolls of the warp yarns wound on the warp beam 12 diminish in diameter during operation of the loom. The increases in the warp yarn tensions thus caused by the changes in the diameters of the yarn rolls on the warp beam 12 are automatically compensated for from time to time by tension adjusting means engaging the guide or back rest roller 14 or otherwise suitably arranged in the loom but, nevertheless, there exist certain periods of time for which the tensions in the warp yarns remain at siezably small values. If the beating of weft yarn inserted into the weaving shed S is effected in such an instance, the signal Sa produced by the tension detector 20 may become lower in magnitude than the reference signal Sr and cause the loom to stop although the weft yarn being beaten up has been properly inserted across the weaving shed S. This causes an unwanted interruption of the weaving operation and also results in impairment of the commercial value of the resultant woven fabric. From this point of view, it is objectionable to reduce the value of the above mentioned coefficient in the reference signal Sr.

In another type of prior-art improper pick detecting device using the tension detector 20, the analog signal Sa obtained during one cycle of operation of the loom is memorized and the analog signal Sa produced during the subsequent cycle of operation is compared with a reference signal which is representative of a certain fraction of the value represented by the signal Sa produced during the immediately preceding cycle. If the variation caused in the warp yarn tensions as a result of the changes in the diameters of the yarn rolls on the warp beam 12 as above mentioned spans between the two consecutive cycles of operation of the loom, the effects of such variation on the analog signals Sa produced during the two cycles are practically cancelled by each other when the signal Sa produced during the latter cycle is compares with the reference signal resulting from the signal Sa produced during the former cycle. The loom equipped with the second type of prior-art improper pick detecting device is thus permitted to operate normally irrespective of the variation in the warp yarn tensions and is free from the above described problem encountered in a loom provided with the first type of prior-art improper pick detecting device.

The tension detector 20 is mounted on the base or frame structure 24 of the loom by means of the shock absorbing material 26 as previously described. Thus, the tension detector 20 per se constitutes a vibration system which is independent, in effect, from the vibration system constituted by the base or frame structure 24 of the loom. If, therefore, the waves of the vibrations occurring in these two independent vibration systems happen to be in phase and interfere constructively, the mechanical pressures transferred from the warp yarns Y to the tension sensing units 22 of the detector 20 are amplified or attenuated by the crests or troughs of the oscillatory waves in the two systems, with the result that the tensions represented by the analog signals delivered from the sensing units 22 become far from the tensions actually produced in the warp yarns Y contacted by the sensing units 22. If the reference signal in the above described second type of improper pick detecting device is produced on the basis of these falso signals, it would also happen that the loom equipped with the detecting device is stopped erroneously in the process of the weaving operation.

In a dobby loom in which the two webs forming the weaving shed therebetween are composed of three or more sets of warp yarns, the warp yarn tensions to be detected further vary periodically from one cycle of operation to another of the loom throughout the cycles for which a complete weave is to be produced. If either of the above described types of prior-art improper pick detecting devices is to be used on a dobby loom, therefore, extreme difficulties are encountered in establishing a criterion for producing a reference signal to be used in the improper pick detecting device.

A prime object of the present invention is to provide an improper pick detecting device in which a pick of weft yarn which has failed to be properly inserted across the weaving shed of warp yarns is detected on the basis of a reference signal which is useful for detecting an occurence of an improper pick without the risk of erroneously interrupting the weaving operation of the loom. The reference signal produced in an improper pick detecting device according to the present invention is, thus, not affected by the cyclic variation in the tensions in the warp yarns and is practically free from the influences of the mechanical vibrations to be produced in the loom in operation.

Figure 2:
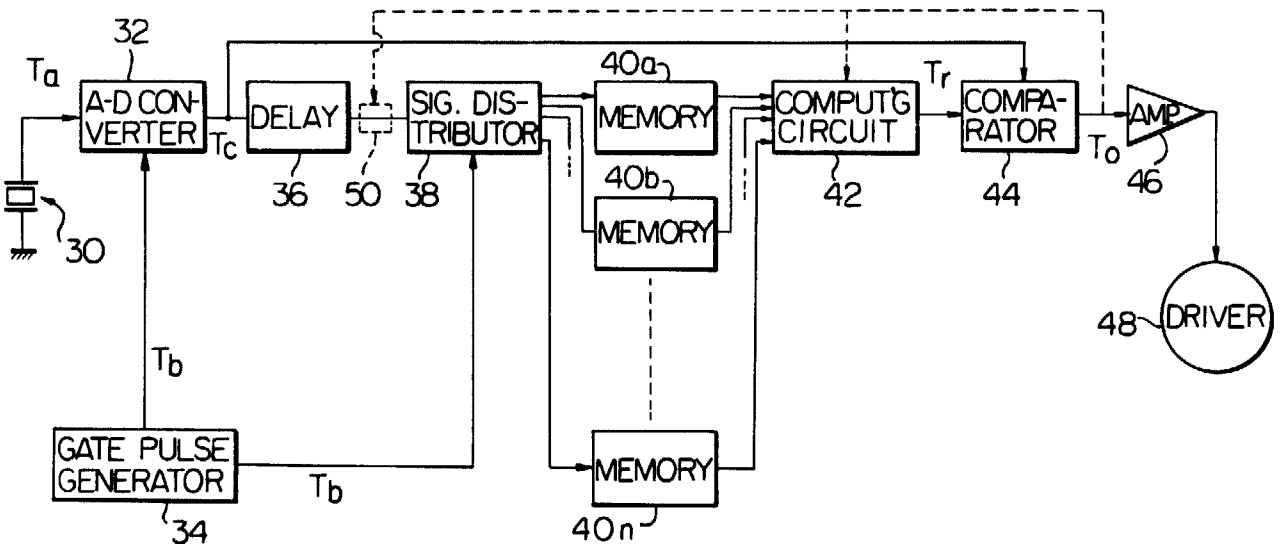
FIG. 2 is a block diagram showing a preferred embodiment of an improper pick detecting device according to the present invention.

FIG. 2 shows a preferred embodiment of such an improper pick detecting device according to the present invention. The device shown comprises a tension detector 30 which per se is similar to the tension detector 20 in the arrangement shown in FIG. 1. The tension detector 30 is thus composed of a tension sensing unit which is arranged to be in contact with a corresponding number of warp yarns forming a lateral end portion of the weaving shed opposite to the weft inserting end of the shed, though not shown in FIG. 2. The tension sensing unit is adapted to produce an analog signal Ta continuously variable with the total of tensions in the warp yarns contacted by the sensing unit and is preferably comprised of a piezoelectric transducer element for producing the analog electric signal Ta in the form of a voltage having such a characteristic. The analog signal Ta thus constantly issuing from the tension detector 30 is fed to an analog-to-digital converter 32 having a gate terminal connected to a gate pulse generator 34. The gate pulse generator 34 is operative to produce a train of pulses Tb which are respectively synchronized with the weaving cycles of the loom and which coincide in timing with the beating operations during the weaving cycles of the loom. Though not shown in the drawings, such a pulse generator 34 may comprise a rotor adapted to be driven for rotation in synchronism with the weaving cycles of the loom, a permanent magnet fixedly mounted on the rotor, and an electromagnetic pick-up element held in position adjacent to the circular path of the permanent magnet on the rotor. The rotor makes a full turn and accordingly the permanent magnet on the rotor approaches the pick-up element once during evey cycle of operation of the loom. The timing at which the permanent magnet on the rotor is thus moved close to the stationary pick-up element is adjusted to be concurrent with the timing at which the beating operation for each cycle of operation of the loom is to take place. The above described example of the pulse generator 34 is merely by way of example and, for this reason, the construction thereof is not herein shown and described in detail.

The gate pulses Tb delivered from the pulse generator 34 are fed in succession to the gate terminal of the above mentioned analog-to-digital converter 32, which is made operative to convert the analog output signal Ta from the tension detector 30 into a corresponding digital signal Tc as an output of the converter each time the pulse Tb from the pulse generator 34 is fed to the converter 32. Each of the digital signals Tb produced by the analog-to-digital converter 32 is, thus, a digital representation of the sum of the warp yarn tensions detected by the tension detector 30 during the beating operation in each cycle of operation of the loom.

The analog-to-digital converter 32 has an output terminal connected to a delay circuit 36 by means of which the digital signal Tc issuing from the analog-to-digital converter 32 is delayed by a predetermined time interval shorter than the duration of each cycle of operation of the loom. Since the beating operation in each cycle of operation of a loom as is well known in the art, the digital signal Tc passed to the delay circuit 36 from the analog-to-digital converter 32 is permitted to appear at the output terminal of the delay circuit 36 from the analog-to-digital converter 32 is permitted to appear at the output terminal of the delay circuit 36 at a timing not later than the timing at which the analog-to-digital converter 32 delivers the digital signal Tc toward the end of the immediately subsequent cycle of operation of the loom.

The output terminal of the delay circuit 36 is connected to a sequential signal distributor circuit 38 having a trigger terminal connected to the above mentioned gate pulse generator 34 and an n number of output terminals which are respectively connected to a corresponding number of memory circuits 40*a*, 40*b*, . . . 40*n*. As the pulses Tb are supplied in succession to the trigger terminal of the sequential signal distributor circuit 38 from the gate pulse generator 34, the signal distributor circuit 38 is triggered and passes the retarded digital signals Tc to the individual memory circuits 40*a*, 40*b*, . . . 40*n* in a sequential fashion. When all the memory circuits 40*a*, 40*b*, . . . 40*n* are filled up, the retarded digital signals Tc continuedly passed through the signal distributor circuit 38 are for a second time distributed sequentially to the memory circircuits 40*a*, 40*b*, . . . 40*c*. When the new signal is thus fed to each of the memory circuits 40*a*, 40*b*, . . . 40*n*, the signal which has been stored therein is cleared and the memory circuit registers the new signal therein until the memory circuit is supplied with a further new signal from the signal distributor circuit 38. The sequential signal distributor circuit 38 may be constituted by an electronic ring counter having a chain of binary units arranged in a circle and having respective trigger terminals jointly connected to the above mentioned trigger terminal of the distributor circuit 38, though not shown in the drawings.

The memory circuits 40*a*, 40*b*, . . . 40*n* have respective output terminals jointly connected to a computing circuit 42 including a series combination of summing and divider networks which are arranged in such a manner as to be capable of producing a predetermined fraction of an arithmetic mean of the values represented by the digital signals Tc passed to the computing circuit 42 from the individual memory circuits 40*a*, 40*b*, . . . 40*b*. The computing circuit 42 produces an output signal Tr which is representative of such a mean value. The above mentioned fraction giving a fixed coefficient in the signal Tr thus delivered from the computing circuit 42 is herein assumed to be 0.8 by way of example. The output signal Tr of the computing circuit 42 is supplied as a variable reference signal to one input terminal of a two-input comparator circuit 44 the other input terminal of which is connected to the output terminal of the previously described analog-to-digital converter 32. The network composed of the delay circuit 36, sequential signal distributor circuit 38, memory circuits 40*a*, 40*b*, . . . 40*n* and computing circuit 42 thus constitute means for producing the variable reference signal Tr to be supplied to the comparator circuit 44.

Each of the digital signals Tc produced by the analog-to-digital converter 32 is supplied not only to the delay circuit 36 but to the comparator circuit 44 and is compared with the above mentioned variable reference signal Tr delivered from the computing circuit 42. When any of the digital signals Tc successively fed to the comparator circuit 44 is lower in magnitude than the variable reference signal Tr, the comparator circuit 44 produces an output signal To, which is supplied by way of an amplifier 46 to a suitable driver 48 which may be a coil of a relay forming part of a suitable emergency stop motion (not shown) adapted to bring the loom to a stop when the relay is.

When the loom is in operation, the analog-to-digital converter 32 is constantly supplied with the analog signal Ta continuously varying with the sum of the warp yarn tensions detected by the tension detector 30. At time intervals which are synchronized with the beating operations in the weaving cycles of the loom, the analog-to-digital converter 32 is further supplied with the pulses Tb from the gate pulse generator 34 and deliveres the digital signals Tc each represents digitally the sum of the detected warp yarn tensions. The digital signals Tc thus delivered from the analog-to-digital converter 32 at timings synchronized with the beating operations of the loom are passed directly to the above described computing circuit 42 at such timings and, through the delay circuit 36 and the signal distributor circuit 38, to the memory circuits 40*a*, 40*b*, . . . 40*n* sequentially and at timings retarded from the original timings of the signals Tc by a predetermined amount of time which is shorter than the duration of each cycle of operation of the loom as previously discussed. The signal Tc delivered from the sequential signal distributor circuit 38 immediately in succession to the signal Tc sent to the last memory circuit 40*n* is passed to the first memory circuit 40*a* so that the signal Tc which has been stored in the first memory circuit 40*a* is cleared and, in lieu thereof, the signal Tc appearing at the output terminal of the delay circuit 36 is passed to and stored in turn in the first memory circuit 40*a*. The memory circuits 40*a*, 40*b*, . . . 40*n* connected in parallel with the sequential signal distributor circuit 38 is thus cyclically and repeatedly supplied with the retarded digital signals Tc successively delivered from the delay circuit 36. Immediately after the weaving operation has been started, therefore, all the memory circuits 40a, 40b, . . . and 40n have stored therein the digital signals Tc which are representative of the sums of the warp tensions detected during the weaving cycles respectively followed by the weaving cycles during which the same digital signals Tc are fed to the memory circuits. The n number of digital signals Tc thus stored in the memory circuits 40a, 40b, . . . 40n are combined in the computing circuit 42 into a single signal representative of the sum of the values respectively represented by the digital signals and the signal representative of such a sum is multiplied, in effect, by a numerical value 0.8/n. The variable reference signal Tr produced in this fashion by the computing circuit 42 represents a 0.8 fraction of the arithmetic mean of the sum of the values represented by the digital signals Tc stored in the individual memory circuits 40a, 40b, . . . 40n. The reference signal Tr is fed to the comparator circuit 44 and is compared with the digital signal Tc directly passed to the comparator circuit 44 from the analog-to-digital converter 32. At a point of time when the digital signal Tc is thus fed from the analog-to-digital converter 32 to the comparator circuit 44, the particular signal Tc is not permitted to reach any of the memory circuits 40a, 40b, . . . 40n due to the retarding effect of the delay circuit 36. The reference signal Tr with which the digital signal Tc produced during each weaving cycle of the loom is to be compared in the comparator circuit 44 is, therefore, representative of the 0.8 fraction of the arithmetic mean value of the sum of the values represented by the digital signals Tc produced in the n number of weaving cycles preceding the weaving cycle in which the digital signal Tc admitted to the comparator circuit 44 is produced. When the digital signal Tc produced and fed to the comparator circuit 44 during a weaving cycle of the loom is lower than the reference signal Tr appearing at the output terminal of the computing circuit 42 in the particular weaving cycle, the comparator circuit 44 delivers the output signal To and energizes the driver 48 for causing the loom to a stop.

By reference, the circuit arrangement shown in FIG. 2 may further comprise switching means by which the digital signal Tc which has turned out to be lower than the reference signal Tr in the comparator circuit 44 is not fed to the memory circuits 40a, 40b, . . . 40n so that the warp yarn tensions detected in the weaving cycle in which the particular digital signal is produced are not taken into account when in forming the reference signal or signals Tr to be produced during the subsequent cycle or cycles of operation of the loom. In FIG. 2, such switching means is shown comprising a normally-closed switch circuit 50 connected between the delay circuit 36 and the sequential signal distributor circuit 38 and having an input terminal connected to the output terminal of the comparator circuit 44 as indicated by a broken line. The switch circuit 50 is adapted to maintain the connection between the delay and signal distributor circuits 36 and 38 when de-energized and to connect the output terminal of the delay circuit 36 to ground when energized by the output signal To delivered from the comparator circuit 44. When the switch circuit 50 is thus made open in the presence of the signal To at the output terminal of the comparator circuit 44, the digital signal Tc delivered from the delay circuit 36 at a certain time interval after the signal has been imparted to the comparator circuit 44 is passed to ground through the switch circuit 50 so that one of the memory circuits 40a, 40b, . . . 40n which has been scheduled to be supplied with the particular digital signal Tc through the signal distributor circuit 38 registers a digit "O" therein. Under these conditions, the comparator circuit 44 is supplied with an n-1 number of digital signals Tc from the memory circuits 40a, 40b, . . . 40n and is operative to multiply the sum of these signals Tc by 0.8/(n-1). For this purpose, the output terminal of the comparator 44 is further connected to the computing circuit 44 so that the output signal To produced by the comparator circuit 44 is fed back to the computing circuit 44 as well as to the switch circuit 50 for furnishing the computing circuit a piece of information indicating that one of the memory circuits 40a, 40b, . . . 40n is vacant.

In a dobby loom in which the weaving shed is formed by three or more sets of warp yarns in each cycle of operation of the loom, the tension in the warp yarns vary not only due to the variation in the diameters of the rolls of the warp yarns on the warp beam but also from one cycle of operation to another for producing a complete weave in the fabric. The complete weave herein mentioned refers to a unit portion of a woven fabric which has a succession of unit portions having a common weave patern containing a predetermined number of weft yarns.

Figure 3:
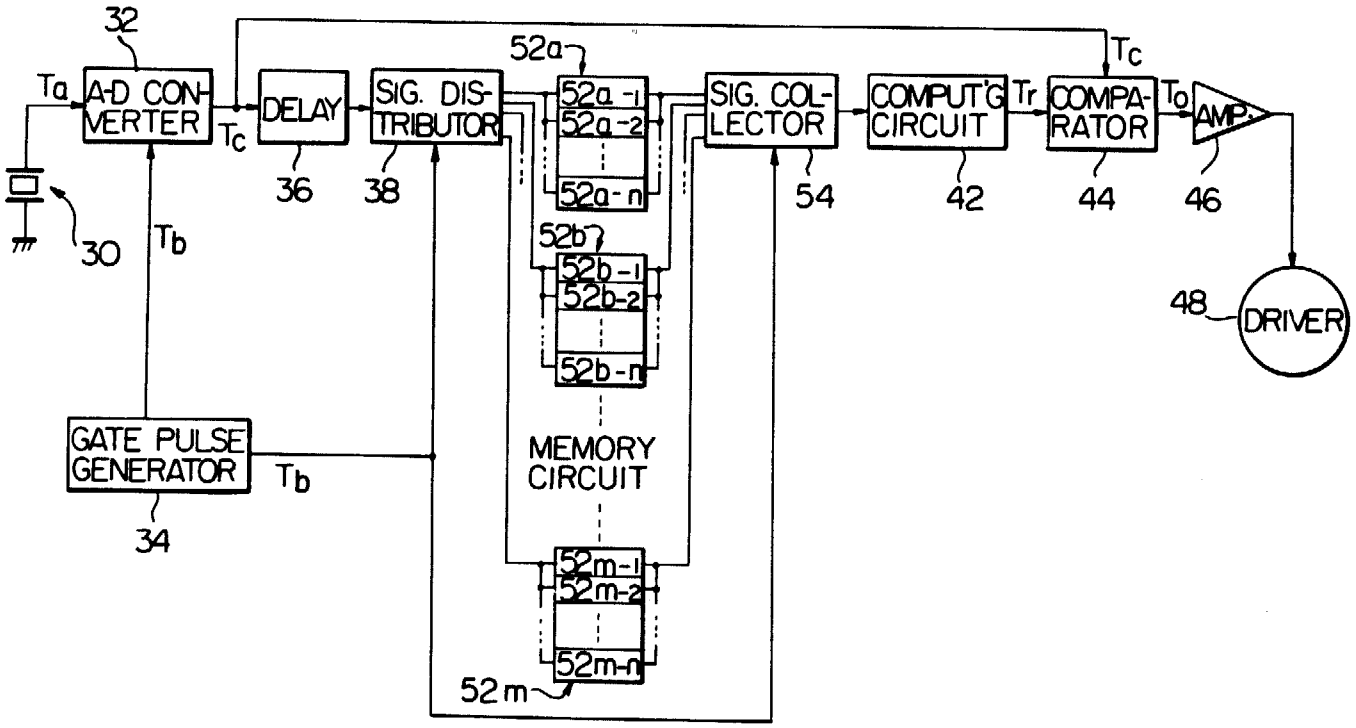
FIG. 3 is a block diagram showing a modification of the embodiment shown in FIG. 2, the modification being adapted for use in a dobby loom.

FIG. 3 shows an improper pick detecting device adapted for use in a dobby loom. In the arrangement herein shown, the above mentioned complete weave assumed to contain an m number of weft yarns (not shown). As well known in the art of dobby looms, a complete weave of an ordinary woven fabric produced by a dobby loom contains a maximum of about 30 weft yarns. Thus, the improper pick detecting device shown in FIG. 3 comprises an m number of memory circuits 52a, 52b, . . . 52n each consisting of an n number of memory units which are indicated by subscripts 1, 2, . . . *n* affixed to each of the notations 52a, 52b and 52n. The memory units of each of the memory circuits 52a, 52b, . . . 52n have respective output terminals jointly connected to each of the output terminals of the sequential signal distributor circuit 38. The digital signals Tc successively delivered from the sequential signal distributor circuit 38 are first fed by turns to the respective first memory units 52a-1, 52b-1, . . . 52m-1, thereafter to the respective second memory units 52a-2, 52b-2, . . . 52m-2, and finally to the respective n-th memory units 52a-n, 52b-n, 52m-n of the individual memory circuits 52a, 52b, . . . 52m. After the n-th memory unit 52m-n of the m-th memory circuit 52m is thus filled up, the digital signals Tc continuedly issuing from the sequential signal distributor circuit 38 are for a second time sequentially passed to the respective first memory units 52a-1, 52b-1, . . . 52m-1 of the individual memory circuits 52a, 52b, . . . 52n. When each of the memory units which have been filled with is supplied with a new signal, the signal which has been stored therein is cleared and the new signal is stored in turn in the particular memory unit. The individual memory units of each of the memory circuits 52a, 52b, . . . 52n have respective output terminals jointly connected to a signal collector circuit 54 having an m number of input terminals each connected to the output terminals of each of the memory circuits 52a, 52b, . . . 52n. The signal collector circuit 54 further has a trigger terminal connected to the output terminal of the gate pulse generator 34 so that the gate pulses Tb produced by the gate pulse generator 34 at time interval synchronized with the beating operations during the weaving cycles of the loom are passed in succession not only to the analog-to-digital converter 32 and the sequential signal distributor circuit 38 as previously described but also to the signal collector circuit 54. The signal collector circuit 54 is thus triggered at time intervals synchronized with the timings at which the retarded digital signals Tc are to be delivered from the sequential signal distributor circuit 38. The digital signals Tc stored in the n times m number of memory units are passed to the signal collector circuit 54 in such a manner that the digital signals stored in the memory units 52*a*-1, 52*a*-2, . . . 52*a*-n of the first memory circuit 52*a* are fed to the collector circuit 54 during a weaving cycle in which the first weft yarn to form a complete weave in the fabric to be woven is to be beaten up and, likewise, the digital signals stored in the memory units 52*b*-1, 52*b*-2, . . . 52*b*-n of the second memory circuit 52*b* are fed to the collector circuit 54 during the next weaving cycle in which the second weft yarn to form the complete weave is to be beaten up. During each of the weaving cycles of the loom, the signal collector circuit 54 is thus supplied with a total of n number of digital signals Tc from each of the memory circuits 52*a*, 52*b*, . . . 52*m*. The digital signals Tc thus collected in the signal collector circuit 42 during each cycle of operation of the loom are fed to the computing circuit 42 for thereby producing the variable reference signal Tr in the same manner as described with reference to FIG. 2.

In the arrangement illustrated in FIG. 3, it is preferable that each of the memory circuits 52*a*, 52*b*, . . . 52*n* contain five or six memory units because, if the reference signal Tr is produced on the basis of two, three or four digital signals Tc, the reference signal is deficient in reliability and, if seven or more memory units are used to construct each of the memory circuits 52*a*, 52*b*, . . . 52*m*, then a disproportionately large-sized and intricate construction of the device will result.

While it has been assumed in the foregoing description that the reference signal Tr is produced on the basis of the arithmetic mean of the detected warp yarn tensions, such a signal may be produced on the basis of the intermediate value or the minimum value of the detected warp yarn tensions if desired.

What is claimed is:

1. A method of detecting an improper pick of weft yarn in a weaving loom having a weft filling stage in which a pick of weft yarn is to be inserted into a weaving shed having a weft inserting end and beaten up onto the fell of a woven cloth during each cycle of operation of the loom, comprising detecting a total of tensions in a predetermined number of warp yarns, producing an electric tension signal representative of the warp yarn tensions detected during beating of the weft yarn in each cycle of operation of the loom, storing each of the tension signals for a predetermined number of consecutive cycles of operation subsequent to each of the cycles in which the tension signals are produced, producing a variable reference signal representative of the values respectively represented by a predetermined number of stored tension signals, comparing each of the tension signals with the reference signal which is produced during the cycle of operation prior to the cycle in which the tension signal to be compared with the reference signal is produced, and producing an output signal if and when the value represented by the tension signal compared with the reference signal is in a predetermined relationship to the value represented by the latter.

2. A method as set forth in claim 1, wherein the tension signal compared with the reference signal and proved to be lower than the latter in any cycle of operation of the loom is eliminated before the particular signal is stored.

3. A method as set forth in claim 1 or 2, wherein the reference signal produced during each cycle of operation of the loom is representative of the values respectively represented by the tension signals produced in said predetermined number of consecutive cycles.

4. A method as set forth in claim 3, wherein each of said tension signals is produced by producing an electric analog signal continuously variable with the total of detected tensions of said warp yarns and converting the analog signal into a corresponding digital signal as said tension signal during beating of weft yarn in each cycle of operation of the loom.

5. A method as set forth in claim 4, wherein said digital signal is retarded by a predetermined amount of time shorter than the duration of each cycle of operation of the loom prior to storage of the signal and is compared without retardation with the reference signal during the cycle of operation in which the particular digital signal is produced.

6. A method as set forth in claim 1 or 2, in which the woven cloth to be produced has a succession of complete weaves each containing a predetermined number of weft yarns, wherein said predetermined number of said consecutive cycles is the product of said predetermined number of the weft yarns in each of said complete weaves and said predetermined number of the stored tension signals Tc and wherein each of said reference signals is produced during each cycle of operation of the loom on the basis of the tension signals produced during the cycles of operation in which the weft yarns to be beaten up occur in the same order in the complete weaves to be produced in the woven cloth.

7. A method as set forth in claim 6, wherein each of said tension signals is produced by producing an electric analog signal continuously variable with the total of detected tensions of said warp yarns and converting said analog signal into a corresponding digital signal as said tension signal during beating of weft yarn in each cycle of operation of the loom.

8. A method as set forth in claim 7, wherein said digital signal is retarded by a predetermined amount of time shorter than the duration of each cycle of operation of the loom prior to storage of the signal and is compared without retardation with the reference signal during the cycle of operation in which the particular digital signal is produced.

9. A method as set forth in claim 1, wherein said predetermined number of warp yarns are chosen from the warp yarns forming a lateral end portion of the shed opposite to said weft inserting end of the shed.

10. A method as set forth in claim 1, wherein said reference signal is representative of a predetermined fraction of the arithmetic mean of the values respectively represented by said predetermined number of stored tension signals.

11. An improper pick detecting device for use in a weaving loom having a weft filling stage in which a pick of weft yarn is to be inserted across a weaving shed having a weft inserting end and beaten up onto the fell of a woven cloth during each cycle of operation of the loom, comprising tension signal generating means for detecting a total of tensions in a predetermined number of warp yarns and producing an electric tension signal representative of the warp yarn tensions detected during beating of the weft yarn in each cycle of operation of the loom, reference signal generating means for storing each of the tension signals for a predetermined number of consecutive cycles of operation subsequent to each of the cycles in which the tension signals are produced and producing a variable reference signal representative of the values respectively represented by a predetermined number of stored tension signals, and comparing means for comparing each of the tension signals with the reference signal which is produced during the cycle of operation prior to the cycle in which the tension signals to be compared with the reference signal is produced and producing an output signal if and when the values represented by the tension signal compared with the reference signal is in a predetermined relationship to the value represented by the latter.

12. An improper pick detecting device as set forth in claim 11, wherein said reference signal generating means comprises a delay circuit connected to said tension signal generating means for retarding each of the tension signals by a predetermined amount of time shorter than the duration of each cycle of operation of the loom, a sequential signal distributor circuit having an input terminal connected to said delay circuit and a plurality of output terminals and operative to pass the retarded tension signals from said delay circuit to said output terminals sequentially and repeatedly as the tension signals are delivered in succession from the delay circuit to the signal distributor circuit, a plurality of memory circuits having respective input terminals respectively connected to the output terminals of the distributor circuit for storing therein the tension signals delivered thereto from said distributor circuit, each of the memory circuits being operative to clear, in response to a new input signal supplied thereto, the signal which has been stored therein, and a computing circuit connected to said memory circuits and operative to produce a variable value representative of the values respectively represented by the signals being stored in said memory circuits, said comparing means having an input terminal connected to said computing circuit for being supplied with said reference signals and an input terminal directly connected to the output terminal of said tension signal generating means for being supplied with said tension signals.

13. An improper pick detecting device as set forth in claim 12, wherein said reference signal generating means further comprises switching means connected between said delay circuit and said signal distributor circuit and having an input terminal connected to the output terminal of said comparing means for connecting the output terminal of the delay circuit to ground during a cycle of operation in which the tension signal compared with the reference signal in said comparing means is proved to be lower than the latter.

14. An improper pick detecting device as set forth in claim 11, wherein said reference signal generating means comprises a delay circuit connected to the output terminal of said tension signal generating means for retarding each of the tension signals by a predetermined amount of time shorter than the duration of each cycle of operation of the loom, a sequential signal distributor circuit having an input terminal connected to the delay circuit and a plurality of output terminals and operative to pass the retarded tension signals from the delay circuit to said output terminals sequentially and repeatedly as the retarded tension signals are delivered in succession from the delay circuit to the signal distributor circuit, a plurality of memory circuits each consisting of a parallel combination of memory units having respective input and output terminals, the respective input terminals of the memory units of each of the memory circuits being jointly connected to each of the output terminals of the signal distributor circuit, the distributor circuit being operative to pass the retarded tension signals sequentially and repeatedly to the memory circuits and sequentially to the memory units of the same order in the individual memory circuits, each of said memory units being operative to clear, in response to a new signal supplied thereto, the signal which has been stored therein, a signal collector circuit having a plurality of input terminals each connected to the respective output terminals of the memory units of each of said memory circuits, said signal collector circuit being operative to receive the signals sequentially from the memory units of one of the memory circuits and thereafter from the memory units of another memory circuit so that the signals stored in the memory units of each memory circuit are supplied to the collector circuit during each cycle of operation of the loom, and a computing circuit connected to the output terminal of said signal collector circuit and operative to produce a variable value representative of the values respectively represented by the signals supplied to said collector circuit during each cycle of operation of the loom, said comparing means having an input terminal connected to said computing circuit for being supplied with said reference signal and an input terminal connected directly to the output terminal of said tension signal generating means for being supplied with said tension signals.

15. An improper pick detecting device as set forth in claim 14, wherein said reference signal generating means further comprises switching means connected between said delay circuit and said signal distributor circuit and having an input terminal connected to the output terminal of said comparing means for connecting the output terminal of the delay circuit to ground during a cycle of operation in which the tension signal compared with the reference signal in said comparing means is proved to be lower than the latter.

16. An improper pick detecting device as set forth in any one of claims 11 to 15, wherein said tension signal generating means comprises tension detecting means for producing an electric analog signal which is continuously variable with the total of detected tension in said warp yarns, and an analog-to-digital converter operative to convert said analog signal into a corresponding digital signal as said tension signal during beating of weft yarn in each cycle of operation of the loom.

17. An improper pick detecting device as set forth in claim 11, wherein said tension signal generating means comprises a tension sensing unit which is arranged to detect the tensions in warp yarns chosen from the warp yarns forming a lateral end portion of said weaving shed opposite to said weft inserting end of the shed.

18. An improper pick detecting device as set forth in claim 12 or 14, wherein said computing circuit is operative to produce as said variable value a predetermined fraction of the arithmetic mean of the values respectively represented by said predetermined number of stored signals.

* * * * *